US005427697A

United States Patent [19]

Swartley

[11] Patent Number: 5,427,697

[45] Date of Patent: Jun. 27, 1995

[54] CLEAR OR TRANSLUCENT, CONCENTRATED FABRIC SOFTENER COMPOSITIONS

[75] Inventor: Donald M. Swartley, Cincinnati, Ohio

[73] Assignee: The Procter & Gamble Company, Cincinnati, Ohio

[21] Appl. No.: 169,859

[22] Filed: Dec. 17, 1993

[51] Int. Cl.[6] ..... D06M 13/46

[52] U.S. Cl. ..... 252/8.8; 252/8.6; 252/8.75

[58] Field of Search ..... 252/8.6, 8.75, 8.8

[56] References Cited

U.S. PATENT DOCUMENTS

| | | | |
|---|---|---|---|
| 4,140,641 | 2/1979 | Ramachandran | 252/8.75 |
| 4,454,049 | 6/1984 | MacGilp et al. | 252/8.8 |
| 5,093,014 | 3/1992 | Nellie | 252/8.6 |

FOREIGN PATENT DOCUMENTS

| | | |
|---|---|---|
| 125103 | 11/1984 | European Pat. Off. . |
| 240727 | 10/1987 | European Pat. Off. . |
| 305065 | 3/1989 | European Pat. Off. . |
| 345842 | 12/1989 | European Pat. Off. . |
| 404471 | 12/1990 | European Pat. Off. . |
| 472178 | 2/1992 | European Pat. Off. . |
| 2300381 | 12/1990 | Japan . |
| 2300382 | 12/1990 | Japan . |

*Primary Examiner*—Mark L. Bell
*Assistant Examiner*—C. M. Bonner
*Attorney, Agent, or Firm*—Beth G. Lewis; Betty J. Zea

[57] ABSTRACT

The present invention relates to clear or translucent, rinse-added fabric softening compositions comprising from about 20% to about 80% imidazoline, imidazolinium, and/or di(2-amidoethyl)methyl quaternary ammonium fabric softener active, from about 2% to about 25% $C_8$–$C_{22}$ mono-alkyl cationic quaternary ammonium compound dispersibility aids, and from about 17% to about 75% non-aqueous organic solvent, wherein the fatty acyl groups of the softener active have an average Iodine Value of at least about 50. Preferably the compositions have a viscosity of from about 15 cps to about 500 cps when diluted with from about 1:1 to about 1:5, softening composition to water.

10 Claims, No Drawings

CLEAR OR TRANSLUCENT, CONCENTRATED FABRIC SOFTENER COMPOSITIONS

TECHNICAL FIELD

The present invention relates to highly concentrated, clear or translucent, liquid textile treatment compositions. In particular, it relates to textile softening compositions for use in the rinse cycle of a textile laundering operation to provide excellent fabric softening/static control benefits, the compositions being characterized by excellent softening, water dispersibility, rewettability, and storage and viscosity stability at sub-normal temperatures.

BACKGROUND OF THE INVENTION

The art discloses problems associated with formulating and preparing clear, concentrated fabric conditioning formulations. For example, European Patent Application No. 404,471, Machin et al., published Dec. 27, 1990, teaches isotropic liquid softening compositions with at least 20% by weight softener and at least 5% by weight of a short chain organic acid.

Although fabric softening compositions containing high solvent levels are known in the art, these compositions are still deficient in providing acceptable cold-water dispersibility and stability at sub-normal temperatures while maintaining satisfactory softening performance. This is due to the general problem that as the level of softener active in the composition increases, the dispersibility of active ingredients in the rinse water can decrease. Softener agglomerates may form and can deposit on clothes which can result in staining and reduced softening performance. Also, compositions may thicken and/or precipitate at low temperatures, i.e., at 35° F. to 65° F., or when diluted 1:1 to 1:5, softening composition to water, e.g., for use in automatic softener dispensers.

The present invention therefore provides concentrated liquid textile treatment compositions having improved stability (i.e., remains clear or translucent and does not precipitate) at sub-normal temperatures under prolonged storage conditions and good cold water dispersibility, together with excellent softening, anti-static and fabric rewettability characteristics across a broad range of fabric types.

The object of the present invention is to provide highly concentrated, clear or translucent rinse-added fabric softening compositions which readily disperse in rinse water, which remain phase stable at low temperatures, and which preferably maintain acceptable viscosity under low dilution conditions, for example when the consumer pre-dilutes the composition by adding water with the composition into the dispensing device of an automatic washing machine or into an automatic dispensing device. The compositions of the present invention preferably maintain acceptable viscosity under these pre-dilution conditions which result in ratios of from about 1:1 to about 1:5, softening composition to water.

SUMMARY OF THE INVENTION

The present invention relates to clear or translucent, rinse-added fabric softening compositions comprising:

(A) from about 20% to about 80% of a softener compound of a formula selected from the group consisting of:

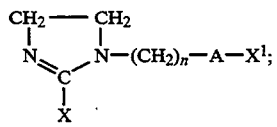

(I)

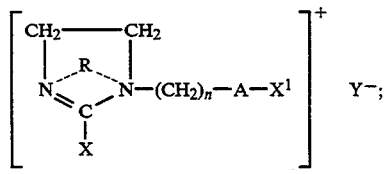

(II)

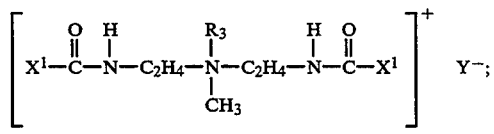

(III)

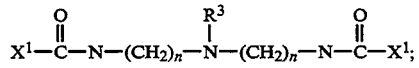

(IV)

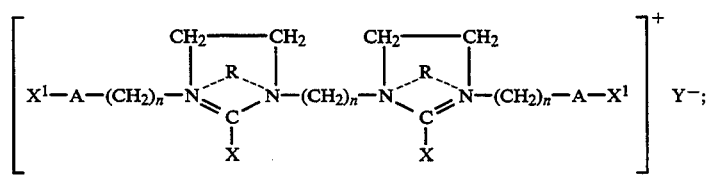

(V)

-continued

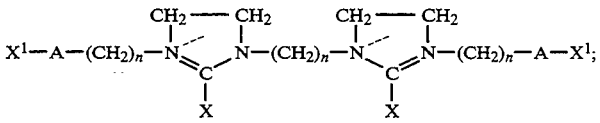

(VI)

and (VII) mixtures thereof;

wherein each A is either —N($R^2$)C(O)—, —C(O)—N($R^2$)—, —O—C(O)—, —C(O)—O—, or a single covalent bond; R is a $C_1$–$C_6$ alkyl group; $R^2$ is a $C_1$–$C_6$ alkyl, alkenyl, hydroxy alkyl or hydrogen; each $R^3$ is a a $C_1$–$C_6$ alkyl, hydrogen, methyl, ethyl, and —$(C_nH_{2n}O)_mH$ wherein n is 2 to 4 and m is from about 1 to about 5, preferably about 3; each X and each $X^1$ are, independently, hydrocarbyl, preferably alkyl, groups containing from about 8 to about 31, preferably from about 10 to about 18, carbon atoms, more preferably straight chain alkyl; n is 2 to 4, preferably 2; and $Y^-$ is any softener-compatible anion such as chloride, bromide, methylsulfate, ethyl sulfate, formate, sulfate, nitrate and the like;

(B) from about 2% to about 25% of a dispersibility aid; and (C) from about 17% to about 75% of a non-aqueous solvent;

wherein X and/or $X^1$ are derived from $C_8$–$C_{31}$ fatty acyl groups having an average Iodine Value of at least about 50, preferably at least about 65, more preferably from about 70 to about 120, even more preferably from about 72 to about 110, and most preferably from about 75 to about 95.

Any reference to Iodine Values herein refers to the Iodine Value of the starting fatty acyl groups and not to the resulting imidazoline, imidazolinium and/or di(2-amidoethyl)methyl quaternary ammonium compounds.

Formulas with higher softener concentrations will typically require higher Iodine Values.

Preferably the compositions of the present invention have a viscosity of from about 15 cps to about 500 cps (i.e., Brookfield, LV Spindle No. 2, 60 rpm, room temperature), preferably from about 15 cps to about 250 cps, when diluted with about 1:1 to about 1:5, softening composition to water.

All percentages, ratios and proportions herein are by weight, unless otherwise specified. All numbers are approximations unless otherwise stated.

DETAILED DESCRIPTION OF THE INVENTION

The present invention contains as an essential component from about 20% to about 80%, preferably from about 30% to about 65%, more preferably from about 40% to about 55% by weight of the composition, a fabric softener active selected from imidazoline, imidazolinium, di(2-amidoethyl)methyl quaternary ammonium compounds and mixtures thereof.

(A) Imidazoline, Imdiazolinium, and Di(2-Amidoethyl) Methyl Quaternary Ammonium Fabric Softening Compounds The compositions of the present invention contain from about 20% to about 80% of an imidazoline, imidazolinium, di(2-amidoethyl)methyl quaternary ammonium compound and mixtures thereof of a formula selected from the group consisting of:

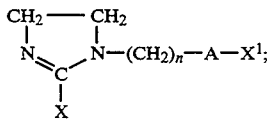

(I)

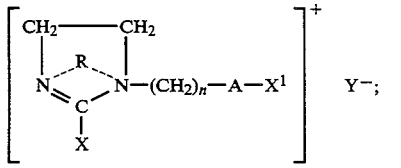

(II)

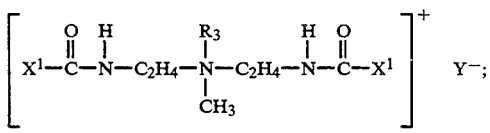

(III)

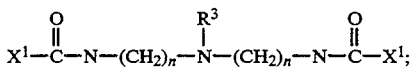

(IV)

-continued

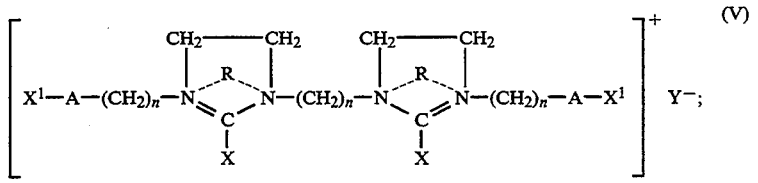

(V)

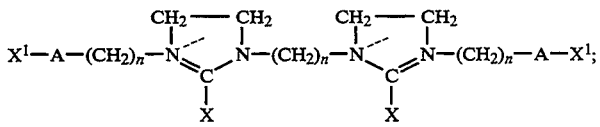

(VI)

and (VII) mixtures thereof;

wherein each A is either —N($R^2$)C(O)—, —C(O)—N($R^2$)—, —O—C(O)—, —C(O)—O—, or a single covalent bond, preferably —N($R^2$)C(O)—, —C(O)—N($R^2$)—, —O—C(O)—, —C(O)—O—, more preferably —O—C(O)—; R is a $C_1$-$C_6$ alkyl group; $R^2$ is a $C_1$-$C_6$alkyl, alkenyl, hydroxy alkyl or hydrogen; each $R^3$ is a $C_1$-$C_6$ alkyl group, hydrogen, methyl, ethyl, and —$(C_nH_{2n}O)_mH$ wherein n is 2 to 4 and m is from about 1 to about 5, preferably about 3; each X and each $X^1$ are, independently, hydrocarbyl, preferably alkyl, groups containing from about 8 to about 31, preferably from about 10 to about 18, carbon atoms, more preferably straight chain alkyl; n is from 2 to 4, preferably 2; and $Y^-$ is any softener-compatible anion such as chloride, bromide, methylsulfate, ethyl sulfate, formate, sulfate, nitrate and the like;

wherein X and/or $X^1$ are derived from $C_8$-$C_{31}$ fatty acyl groups having an average Iodine Value of at least about 50, preferably at least about 65, more preferably from about 70 to about 120, even more preferably from about 72 to about 110, and most preferably from about 75 to about 95.

Compound number (IV) above is a neutralization product of an amine compound with an inorganic acid or an organic acid containing from about 1 to about 6 carbon atoms.

Compounds prepared with at least partially unsaturated acyl groups provide improved concentratability and storage stability (i.e., remain clear or translucent and do not precipitate), especially at subnormal temperatures.

Odor problems can develop as the Iodine Value increases. Surprisingly, some highly desirable, readily available sources of fatty acids such as tallow, possess odors that remain with the softener active compounds despite the chemical and mechanical processing steps which convert the raw tallow to finished softener active. Such sources must be deodorized, e.g., by absorption, distillation (including stripping such as steam stripping), etc. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior concentratability and/or dispersibility achieved.

It will be understood that X and $X^1$ can optionally be substituted with various groups such as alkoxyl or hydroxyl groups.

The above compounds used as the primary active softener ingredient in the practice of this invention are prepared using standard reaction chemistry.

For example, in a typical synthesis of a substituted imidazoline ester softening compound of formula (I) above, a fatty acid of the formula XCOOH is reacted with a hydroxyalkylenediamine of the formula $NH_2$—$CH_2CH_2$—NH—$(CH_2)_nOH$ to form an intermediate imidazoline precursor, which is then reacted with a methyl ester of a fatty acid of the formula:

$X^1C(O)OCH_3$ to yield the desired reaction product (wherein X, $X^1$, and n are as defined above). It will be appreciated by those of ordinary skill in the chemical arts that this reaction sequence allows a broad selection of compounds to be prepared.

The following are nonlimiting examples of softener actives of the present invention: methyl-1-alkyl amidoethyl-2-alkyl imidazolinium methyl- sulfate, available under the trade name Varisoft® 3690 from Sherex Chemical Co. and diquaternary imidazolinium compounds having a ethylene, propylene, etc., bridge between the nitrogen atoms, for example tallow imidazolinium methosulfate diquaternary available under the trade name Varisoft® 6112 (1,1'-ethylene bis(1-methyl-2-soft tallow) imidazolinium bis(methosulfate), from Sherex Chemical Co.

The compositions of the present invention can comprise softener actives such as those of formula (III), di(2-amidoethyl)methyl quaternary ammonium salts, which are described in U.S. Pat. No. 4,439,335, Burns, issued on Mar. 27, 1984, and U.S. Pat. No. 4,134,840, Minegishi et al, issued on Jan. 16, 1979, which are herein incorporated by reference. Example of these compounds includes methyl bis(alkylamidoethyl)2-hydroxyethyl ammonium methyl sulfate, ethoxylated wherein $R_3$ is ethylene oxide, known under the trade name of Varisoft® 222 LT from Sherex Chemical Co., di(2-oleylamidoethyl) propoxylated (3 propoxy groups)-methyl ammonium bromide, di(2palmitoleylamidoethyl) dimethyl ammonium ethylsulfate, and di(2-tallowamidoethyl)ethoxylated methyl ammonium methylsulfate.

Other types of substituted imidazoline softening compounds can also be used herein. Examples of such compounds include:

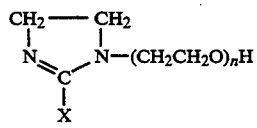

(i)

-continued

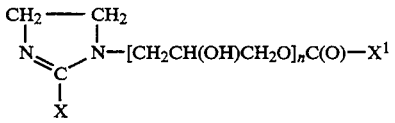

(ii)

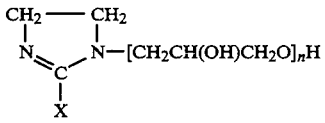

(iii)

wherein X, $X^1$, and n are as previously defined. The above list is intended to be illustrative of other types of substituted imidazoline softening compounds which can be used in the present invention.

B. Dispersibility Aids

The dispersibility aids of the present invention are selected from the group consisting of mono long-chain-alkyl cationic quaternary ammonium compounds, mono long-chain-alkyl amine oxides, and mixtures thereof, at a total level of from about 2% to about 25%, preferably from about 3% to about 17%, more preferably from about 4% to about 15%, and even more preferably from 5% to about 13% by weight of the composition. These materials can either be added as part of the active softener raw material, (A), or added as a separate component. The total level of dispersibility aid includes any amount that may be present as part of component (A).

Preferably the compositions of the present invention have a viscosity of from about 15 cps to about 500 cps, preferably from about 15 cps to about 250 cps, when diluted with about 1:1 to about 1:5, softening composition to water.

Mono-long-chain Alkyl Cationic Quaternary Ammonium Compound

The mono-long-chain alkyl cationic quaternary ammonium compound is at a level of from about 2% to about 25%, preferably from about 3% to about 17%, more preferably from about 4% to about 15%, and even more preferably from 5% to about 13% by weight of the composition, the total mono-long-chain alkyl cationic quaternary ammonium compound being at least at an effective level.

Such mono-long-chain alkyl cationic quaternary ammonium compounds useful in the present invention are, preferably, quaternary ammonium salts of the general formula:

$$[R^4N^+(R^5)_3]Y^-$$

wherein $R^4$ is $C_8$–$C_{22}$ alkyl or alkenyl group, preferably $C_{10}$–$C_{18}$ alkyl or alkenyl group; more preferably $C_{10}$–$C_{14}$ or $C_{16}$–$C_{18}$ alkyl or alkenyl group;

each $R^5$ is a $C_1$–$C_6$ alkyl or substituted alkyl group (e.g., hydroxy alkyl), preferably Cl–$C_3$ alkyl group, e.g., methyl (most preferred), ethyl, propyl, and the like, a benzyl group, hydrogen, a polyethoxylated chain with from about 2 to about 20 oxyethylene units, preferably from about 2.5 to about 13 oxyethylene units, more preferably from about 3 to about 10 oxyethylene units, and mixtures thereof; and $Y^-$ is as defined hereinbefore for (A).

Especially preferred dispersibility aids are monolauryl trimethyl ammonium chloride and monotallow trimethyl ammonium chloride available from Witco under the trade name Varisoft ® 47.

The $R^4$ group can also be attached to the cationic nitrogen atom through a group containing one, or more, ester, amide, ether, amine, etc., linking groups which can be desirable for increased concentratability of component (A), etc. Such linking groups are preferably within from about one to about three carbon atoms of the nitrogen atom.

Mono-alkyl cationic quaternary ammonium compounds also include $C_8$–$C_{22}$ alkyl choline esters. The preferred dispersibility aids of this type have the formula:

$$X^1C(O)—O—CH_2CH_2N^+(R^5)_3\ Y^-$$

wherein $X^1$, $R^5$ and $Y^-$ are as defined previously.

Highly preferred dispersibility aids include $C_{12}$–$C_{14}$ coco choline ester and $C_{16}$–$C_{18}$ tallow choline ester.

Suitable biodegradable single-long-chain alkyl dispersibility aids containing an ester linkage in the long chains are described in U.S. Pat. No. 4,840,738, Hardy and Walley, issued Jun. 20, 1989, said patent being incorporated herein by reference.

When the dispersibility aid comprises alkyl choline esters, preferably the compositions also contain a small amount, preferably from about 2% to about 5% by weight of the composition, of organic acid. Organic acids are described in European Patent Application No. 404,471, Machin et al., published on Dec. 27, 1990, supra, which is herein incorporated by reference. Preferably the organic acid is selected from the group consisting of glycolic acid, acetic acid, citric acid, and mixtures thereof.

Ethoxylated quaternary ammonium compounds which can serve as the dispersibility aid include ethylbis(polyethoxy ethanol)alkylammonium ethylsulfate with 17 moles of ethylene oxide, available under the trade name Variquat ® 66 from Sherex Chemical Company; polyethylene glycol (15) oleammonium chloride, available under the trade name Ethoquad ® 0/25 from Akzo; and polyethylene glycol (15) cocomonium chloride, available under the trade name Ethoquad ® C/25 from Akzo.

Although the main function of the dispersibility aid is to increase the dispersibility of the ester softener, preferably the dispersibility aids of the present invention also have some softening properties to boost softening performance of the composition. Therefore, preferably the compositions of the present invention are essentially free of non-nitrogenous ethoxylated nonionic dispersibility aids which will decrease the overall softening performance of the compositions.

Also, quaternary compounds having only a single long alkyl chain, can protect the cationic softener from interacting with anionic surfactants and/or detergent builders that are carried over into the rinse from the wash solution.

Amine Oxides

Suitable amine oxides include those with one alkyl or hydroxyalkyl moiety of about 8 to about 22 carbon atoms, preferably from about 10 to about 18 carbon atoms, more preferably from about 8 to about 14 carbon atoms, and two alkyl moieties selected from the group consisting of alkyl groups and hydroxyalkyl groups with about 1 to about 3 carbon atoms.

Examples include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dimethyl-2-hydroxyoctadecylamine oxide, and coconut fatty alkyl dimethylamine oxide.

(C) Solvent System

The compositions of the present invention comprise from about 17% to about 75% of a non-aqueous organic solvent, preferably from about 20% to about more preferably from about 25% to about 45%, by weight of the composition, preferably selected from the group consisting of:

(a) short chain alkyl alcohols;
(b) arylalkyl alcohols;
(c) alkylene glycols;
(d) alkylene polyols;
(e) poly(alkylene glycols);
(f) poly(alkylene polyols);
(g) alkyl esters;
(h) alkyl ethers;
(i) alkylene carbonates; and
(j) mixtures thereof; more preferably the non-aqueous solvent is selected from the group consisting of: (a) short chain alkyl alcohols; (b) arylalkyl alcohols; (c) alkylene glycols; (e) poly (alkylene glycols); (h) alkyl ethers; (i) alkylene carbonates; and mixtures thereof; more preferably the solvent is selected from the group consisting of ethanol, propylene glycol, propylene carbonate, diethylene glycol monobutyl ether (i.e., butyl carbitol), dipropylene glycol, phenylethyl alcohol, 2-methyl-1, 3 propanediol, and mixtures thereof; and even more preferably the solvent is selected from the group consisting of propylene glycol, propylene carbonate, diethylene glycol monobutyl ether, phenylethyl alcohol and mixtures thereof. An especially preferred solvent is propylene carbonate.

Examples of some of the above solvents useful in the compositions of the present invention include $C_1$–$C_{14}$ alkanols (i.e., ethanol, propanol, isopropanol, N-butyl alcohols, t-butyl alcohols); $C_1$–$C_6$ alkylene polyols, preferably ethylene, diethylene, propylene, and dipropylene glycols; glycerol and esters thereof. Poly(alkylene) glycols include polyethylene glycol-200, 300, 400, or 600, wherein the suffixed numbers indicate the approximate molecular weight of the glycol.

Glycol ethers include lower-(alkoxy)- or lower(alkoxy)-ethers of ethanol or isopropanol. Many glycol ethers are available under the trade names Arcosolve ® (Arco Chemical Co.) or Cellosolve ®, Carbitol ®, or Propasol ® (Union Carbide Corp.), and include, e.g., butylCarbitol ®, hexylCarbitol ®, methylCarbitol ®, and Carbitol ® itself. The choice of glycol ether can be readily made by one skilled in the art on the basis of its volatility, water-solubility, weight percentage of the total composition and the like.

The most preferred solvents for use in the present invention, for example, propylene carbonate and propylene glycol generally have a high flash point. The solvent system is selected to minimize any reaction with the softener active described above.

Preferably the composition contains no greater than about 5% short chain alkyl alcohol, i.e., ethanol, more preferably not greater than about 3% by weight of the composition. The solvent system is selected to preferably maintain the flash point at acceptable levels, preferably at least about 100° F., more preferably at least about 150° F.

The solvent system employed in the compositions of the present invention can contain water. The level of water in the solvent system is preferably no greater than about 15%, more preferably no greater than about 11%, and even more preferably no greater than about 5% by weight of the composition. Water can help to dissolve optional ingredients and can help to increase the flash point of the composition.

Low molecular weight organic solvent, e.g., less than about 100, lower alcohols such as ethanol, propanol, isopropanol, butanol, monohydric, dihydric (glycol, etc.), trihydric (glycerol, etc.), and higher polyhydric (polyols) alcohols, etc., should be minimized because they lower the flash point of the composition. Low levels of these alcohols will aid in the dispersibility of the composition in water and the storage stability at subnormal temperatures.

Optional Stabilizers

Stabilizers can be present in the compositions of the present invention The term "stabilizer," as used herein, includes antioxidants and reductive agents. These agents are present at a level of from 0% to about 2%, preferably from about 0.01% to about 0.2%, more preferably from about 0,035% to about 0.1% for antioxidants, and more preferably from about 0.01% to about 0.2% for reductive agents. These assure good odor stability under long term storage conditions. Antioxidants and reductive agent stabilizers are especially critical for unscented or low scent products (no or low perfume).

Examples of antioxidants that can be added to the compositions of this invention include a mixture of ascorbic acid, ascorbic palmitate, propyl gallate, available from Eastman Chemical Products, Inc., under the trade names Tenox ® PG and Tenox ® S-1; a mixture of BHT (butylated hydroxytoluene), BHA (butylated hydroxyanisole), propyl gallate, and citric acid, available from Eastman Chemical Products, Inc., under the trade name Tenox ®-6; butylated hydroxytoluene, available from UOP Process Division under the trade name Sustane ® BHT; tertiary butylhydroquinone, Eastman Chemical Products, Inc., as Tenox ® TBHQ; natural tocopherols, Eastman Chemical Products, Inc., as Tenox ® GT-1/GT-2; and butylated hydroxyanisole, Eastman Chemical Products, Inc., as BHA; long chain esters ($C_8$–$C_{22}$) of gallic acid, e.g., dodecyl gallate; Irganox ® 1010; Irganox ® 1035; Irganox ® B 1171; Irganox ® 1425; Irganox ® 3114; Irganox ® 3125; and mixtures thereof; preferably Irganox ® 3125, Irganox ® 1425, Irganox ® 3114, and mixtures thereof; more preferably Irganox ® 3125 alone or mixed with citric acid and/or other chelators such as isopropyl citrate, Dequest ® 2010, available from Monsanto with a chemical name of 1-hydroxyethylidene-1, 1-diphosphonic acid (etidronic acid), and Tiron ®, available from Kodak with a chemical name of 4,5-dihydroxy-m-benzene-sulfonic acid/sodium salt, and DTPA ®, available from Aldrich with a chemical name of diethylenetriaminepentaacetic acid.

The chemical names and CAS numbers for some of the above stabilizers which can be used in the compositions of the present invention are listed in Table I below.

TABLE I

| Antioxidant | CAS No. | Chemical Name used in Code of Federal Regulations |
|---|---|---|
| Irganox ® 1010 | 6683-19-8 | Tetrakis methylene(3,5-di-tert-butyl-4 hydroxyhydrocinnamate)]methane |
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydrocinnammamide |
| Irganox ® B 1171 | 31570-04-4 1098 23128-74-7 | 1:1 Blend of Irganox ® and Irgafos ® 168 |
| Irganox ® 1425 | 65140-91-2 | Calcium is[monoethyl(3,5-di-tert-butyl-4-hydroxybenzyl)-phosphonate] |
| Irganox ® 3114 | 27676-62-6 | 1,3,5-Tris(3,5-di-tert-butyl-4-hydroxybenzyl)-s-triazine-2,4,6-(1H, 3H, 5H)trione |
| Irganox ® 3125 | 34137-09-2 | 3,5-Di-tert-butyl-4-hydroxy-hydrocinnamic acid triester with 1,3,5-tris(2-hydroxy-ethyl)-S-triazine-2,4,6-(1H, 3H, 5H)-trione |
| Irgafos ® | 16831570-04-4 | Tris(2,4-di-tert-butyl-phenyl)phosphite |

Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink-/Hardy/Trinh, issued Sep. 11, 1990, discloses specific preferred soil release agents comprising cationic functionalities, said patent being incorporated herein by reference.

More complete disclosure of highly preferred soil release agents is contained in European Pat. Application 185,427, Gosselink, published Jun. 25, 1986, and U.S. Pat. No. 5,207,933, Trinh et al., issued May 4, 1993, both of which are incorporated herein by reference.

Optional Bacteriocides

Examples of bacteriocides that can be used in the compositions of this invention are parabens, especially methyl, glutaraldehyde, formaldehyde, 2-bromo-2-nitropropane-1,3-diol sold by Inolex Chemicals under the trade name Bronopol ®, and a mixture of 5-chloro-2-methyl-4-isothiazoline-3-one and 2-methyl-4-isothiazoline-3-one sold by Rohm and Haas Company under the trade name Kathon ® CG/ICP. Typical levels of bacteriocides used in the present compositions are from about 1 ppm to about 2,000 ppm by weight of the composition, depending on the type of bacteriocide selected. Methyl paraben is especially effective for mold growth in aqueous fabric softening compositions with under 10% by weight of the ester compound.

Other Optional Ingredients

The present invention can include other optional components conventionally used in textile treatment compositions, for example, colorants, perfumes, preservatives, optical brighteners, opacifiers, fabric conditioning agents, surfactants, stabilizers such as guar gum, anti-shrinkage agents, anti-wrinkle agents, fabric crisping agents, anti-spotting agents, germicides, fungicides, anti-corrosion agents, anti-foam agents, and the like.

Compostions of the present invention optionally can contain other softener actives such as those discloses in P&G patent application Ser. No. 08/169,858, now U.S. Pat. No. 5,399,272, filed on Dec. 17, 1993, Donald M. Swartley et al., "Clear or Translucent, Concentrated Biodegradable Quaternary Ammonium Fabric Softener Compositions", which is incorporated herein by reference.

Method of Softening

In the method aspect of this invention, fabrics or fibers are contacted with an effective amount, generally from about 10 ml to about 150 ml (per 3.5 kg of fiber or fabric being treated) of the softener composition (including ester compound) herein in an aqueous rinse bath. Of course, the amount used is based upon the judgment of the user, depending on concentration of the composition, fiber or fabric type, and degree of softness desired. Preferably, the rinse bath contains from about 10 to about 1,000 ppm, more preferably from about 50 to about 500 ppm, and even more preferably from about 50 to about 150 ppm, of total active fabric softening compounds herein.

The following are non-limiting examples of the present invention.

EXAMPLE I

| Component | Wt. % |
|---|---|
| Softener Compound[1] | 50.22 |
| Lauryl Trimethyl Ammonium Chloride | 8.26 |
| Ethanol | 8.93 |
| Isopropyl Alcohol | 16.74 |
| Water | 14.06 |
| Perfume | 1.79 |
| Total | 100.00 |

Viscosity is about 55 cps as measured with a Brookfield Viscometer LVTD, at 60 rpm, LV Spindle No. 2, at 40° F.

[1]2-($C_{17}$ and $C_{17}$ unsaturated alkyl)-1-[2-($C_{18}$ and $C_{18}$ unsaturated amido)ethyl]-4,5-dihydro-3-methyl-methyl sulfate.

The above composition is made by the following process:

1. Thoroughly mixing (with low agitation) the softener compound, ethanol and isopropyl alcohol at room temperature (70°–80° F.);
2. Adding the perfume and mixing with low agitation; and
3. Thoroughly mixing and adding into the above mixture, an aqueous solution of lauryl trimethyl ammonium chloride, at room temperature.

The above composition is clear and phase stable at 40° F.

EXAMPLE II

| Component | Wt. % |
|---|---|
| Softener Compound[1] | 50.00 |
| Propylene Carbonate | 16.30 |
| Ethanol | 10.00 |
| Lauryl Trimethyl Ammonium Chloride | 8.03 |
| Water | 13.67 |
| Perfume | 2.00 |

-continued

| Component | Wt. % |
|---|---|
| Total | 100.00 |

[1]2-($C_{17}$ and $C_{17}$ unsaturated alkyl)-1-[2-($C_{18}$ and $C_{18}$ unsaturated amido)ethyl]-4,5-dihydro-3-methyl-methyl sulfate.

The above composition is made by the following process:

1. Thoroughly mixing (with low agitation) the softener compound, propylene carbonate, and ethanol at room temperature (70°–80° F.);
2. Adding the perfume and mixing with low agitation; and
3. Thoroughly mixing and adding into the above mixture, an aqueous solution of lauryl trimethyl ammonium chloride, at room temperature.

The above composition is clear and phase stable at 40° F.

EXAMPLE III

| Component | Wt. % |
|---|---|
| Softener Compound[1] | 25.00 |
| Ester Compound[2] | 25.00 |
| Lauryl Trimethyl Ammonium Chloride | 8.03 |
| Ethanol | 28.30 |
| Water | 13.67 |
| Total | 100.00 |

Viscosity is 10–50 cps as measured with a Brookfield Viscometer LVTD, at 60 rpm, LV Spindle No. 2, at 80° F.

[1]2-($C_{17}$ and $C_{17}$ unsaturated alkyl)-1-[2-($C_{18}$ and $C_{18}$ unsaturated amido)ethyl]-4,5-dihydro-3-methyl-methyl sulfate.

[2]Di(tallowoyloxyethyl)dimethyl ammonium chloride where the fatty acyl groups are derived from fatty acids with an Iodine Value of about 50 to about 60. The ester includes monoester at a weight ratio of 16:1, diester to monoester.

The above composition is made by the following process:

1. Thoroughly mixing (with low agitation) the softener compound and ethanol at room temperature (70°–80° F.);
2. Adding the ester compound and mixing with low agitation; and
3. Thoroughly mixing and adding into the above mixture, an aqueous solution of lauryl trimethyl ammonium chloride, at room temperature.

EXAMPLE IV

| Component | Wt. % |
|---|---|
| Softener Compound[1] | 27.11 |
| Ester Compound[2] | 27.07 |
| Ethanol | 19.34 |
| Lauryl Trimethyl Ammonium Chloride | 8.69 |
| Water | 14.78 |
| Isopropyl Alcohol | 3.01 |
| Total | 100.00 |

[1]Poly(oxy-1,2-ethanediyl),alpha{2-[bis(2-amidoethyl)methyl-ammonio]ethyl}-omega-hydroxy-,N,N'-di($C_{14-18}$ and $C_{16-18}$ unsaturated) methyl sulfate.

[2]Di(tallowoyloxyethyl)dimethyl ammonium chloride where the fatty acyl groups are derived from fatty acids with an Iodine Value of about 50 to about 60. The ester includes monoester at a weight ratio of 16:1, diester to monoester.

The above composition is made by the following process:

1. Thoroughly mixing (with low agitation) the softener compound, ethanol, and isopropyl alcohol at room temperature (70°–80° F.);
2. Adding the ester compound and mixing with low agitation; and
3. Thoroughly mixing and adding into the above mixture, an aqueous solution of lauryl trimethyl ammonium chloride, at room temperature.

EXAMPLE V

| Component | Wt. % |
|---|---|
| Softener Compound[1] | 50.00 |
| Ethanol | 4.44 |
| Lauryl Trimethyl Ammonium Chloride | 8.03 |
| Propylene Carbonate | 16.30 |
| Water | 13.67 |
| Perfume | 2.00 |
| Isopropyl Alcohol | 5.56 |
| Total | 100.00 |

[1]Poly(oxy-1,2-ethanediyl),alpha{2-[bis(2-amidoethyl)methyl-ammonio] ethyl}-omega-hydroxy-,N,N'-di($C_{14-18}$ and $C_{16-18}$ unsaturated) methyl sulfate.

The above composition is made by the following process:

1. Thoroughly mixing (with low agitation) the softener compound, ethanol, and isopropyl alcohol at room temperature (70°–80° F.);
2. Adding the perfume and mixing with low agitation; and
3. Thoroughly mixing and adding into the above mixture, an aqueous solution of lauryl trimethyl ammonium chloride, at room temperature.

What is claimed is:

1. A clear or translucent, rinse-added fabric softening composition comprising:

(A) from about 20% to about 80% of a softener compound of a formula selected from the group consisting of:

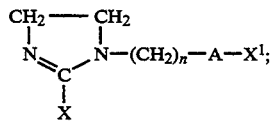

(I)

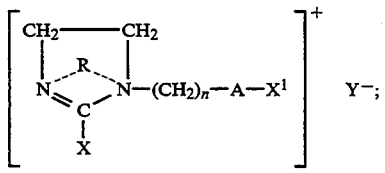

(II)

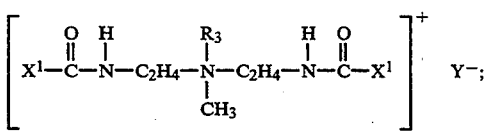

(III)

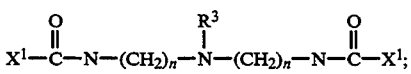

(IV)

-continued (V)

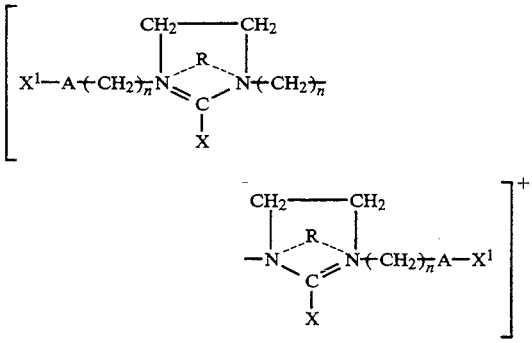

(VI)

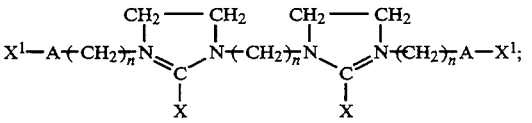

and (VII) mixtures thereof, wherein each A is either —N($R^2$)C(O)—, —C(O)—N($R^2$)—, —O—C(O)—, —C(O)—O—, or a single covalent bond; each R is a $C_1$-$C_6$ alkyl group; each $R^2$ is a $C_1$-$C_6$ alkyl, alkenyl, hydroxy alkyl or hydrogen; each $R_3$ is a hydrogen, methyl, ethyl, or —$(C_nH_{2n}O)_xH$ wherein n is 2 or 3 and x is from about 1 to about 5; each X and each $X^1$ is, independently, a hydrocarbyl group containing from about 8 to about 31 carbon atoms; n is from 2 to 4; and $Y^-$ is any softener-compatible anion;

(B) from about 2% to about 25% of a dispersibility aid; and (C) from about 17% to about 75% of a non-aqueous solvent;

wherein X, $X^1$, or mixtures thereof are derived from $C_{11}$-$C_{31}$ fatty acyl groups having an Iodine Value of from about 72 to about 110.

2. The composition of claim 1 wherein the Iodine Value is from about 75 to about 95.

3. A clear or translucent, rinse-added fabric softening composition comprising:

(A) from about 20% to about 80% of a softener compound of a formula selected from the group consisting of:

(I)

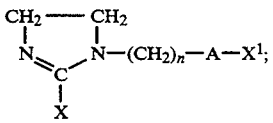

(II)

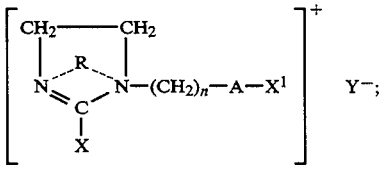

(III)

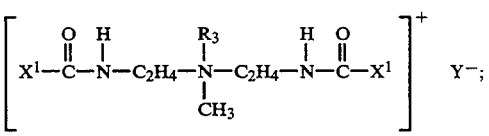

-continued (IV)

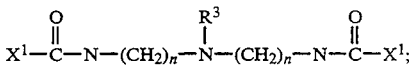

(V)

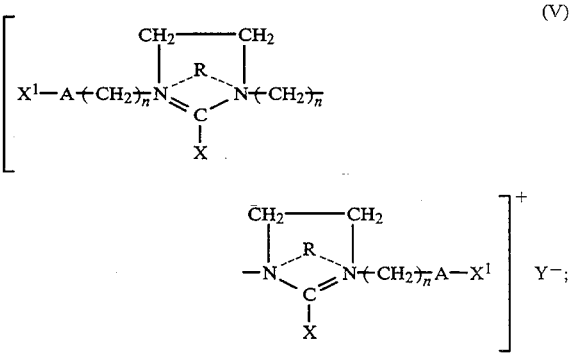

(VI)

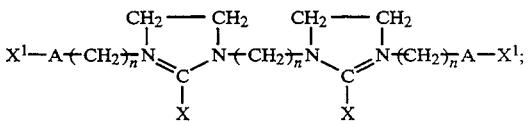

and (VII) mixtures thereof;

wherein each A is either —N($R^2$)C(O)—, —C(O)—N($R^2$)—, —O—C(O)—, —C(O)—O—, or a single covalent bond; each R is a $C_1$-$C_6$ alkyl group; each $R^2$ is a $C_1$-$C_6$ alkyl, alkenyl, hydroxy alkyl or hydrogen; each $R_3$ is a hydrogen, methyl, ethyl, or —$(C_nH_{2n}O)_xH$ wherein n is 2 or 3 and x is from about 1 to about 5; each X and each $X^1$ is, independently, a hydrocarbyl group containing from about 10 to about 18 carbon atoms; n is from 2 to 4; and $Y^-$ is any softener-compatible anion;

(B) from about 2% to about 25% of a dispersibility aid; and (C) from about 17% to about 75% of a nonaqueous solvent, comprising propylene carbonate;

wherein X, $X^1$, or mixtures thereof are derived from $C_{11}$-$C_{31}$ fatty acyl groups having an Iodine Value of from about 72 to about 110.

4. The composition of claim 3 wherein the Iodine Value is from about 75 to about 95.

5. A clear or translucent, rinse-added fabric softening composition comprising:

(A) from about 20% to about 80% of a softener compound of a formula selected from the group consisting of:

(I)

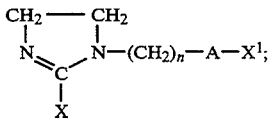

(II)

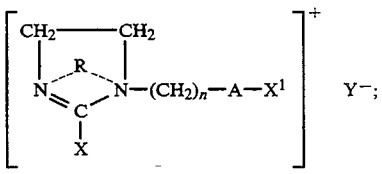

-continued

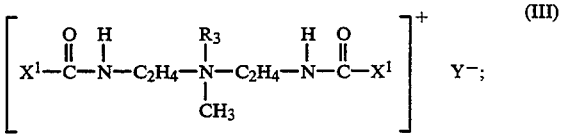

(III)

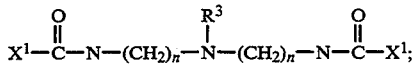

(IV)

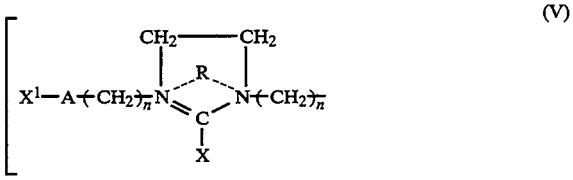

(V)

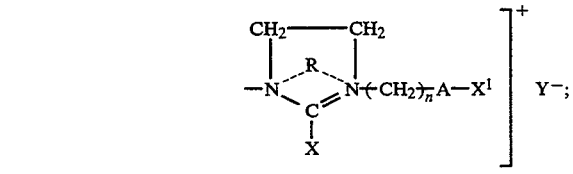

(VI)

and (VII) mixtures thereof;

wherein each A is either —N(R²)C(O)—, —C(O)—N(R²)—, —O—C(O)—, —C(O)—O—, or a single covalent bond; each R is a $C_1$–$C_6$ alkyl group; each R²is a $C_1$–$C_6$ alkyl, alkenyl, hydroxy alkyl or hydrogen; each $R_3$ is a hydrogen, methyl, ethyl, or —$(C_nH_{2n}O)_xH$ wherein n is 2 or 3 and x is from about 1 to about 5; each X and each $X^1$ is, independently, a hydrocarbyl group containing from about 10 to about 18 carbon atoms; n is from 2 to 4; and $Y^-$ is any softener-compatible union;

(B) from about 2% to about 25% of a dispersibility aid; and (C) from about 17% to about 75% of a nonaqueous solvent, comprising propylene carbonate;

wherein X, $X^1$, or mixtures thereof are derived from $C_{11}$–$C_{31}$ fatty acyl groups having an Iodine Value of at least about 50.

6. A clear or translucent, rinse-added fabric softening composition comprising:

(A) from about 20% to about 80% of a softener compound of a formula selected from the group consisting of:

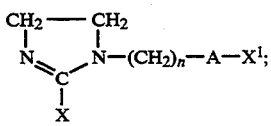

(I)

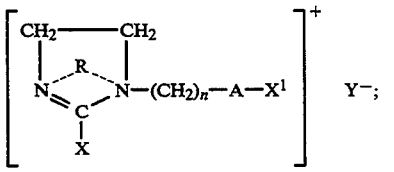

(II)

-continued

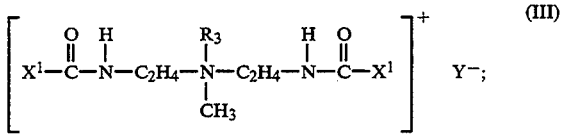

(III)

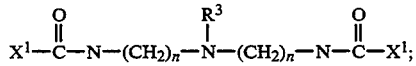

(IV)

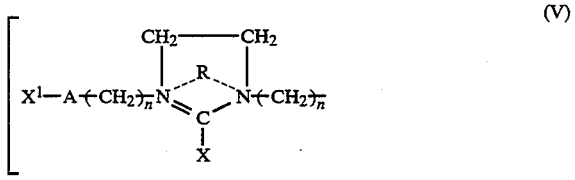

(V)

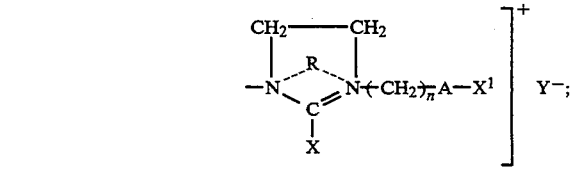

(VI)

and (VII) mixtures thereof;

wherein each A is either —N(R²)C(O)—, —C(O)—N(R²)—, —O—C(O)—, —C(O)—O—, or a single covalent bond; each R is a $C_1$–$C_6$ alkyl group; each R²is a $C_1$–$C_6$ alkyl, alkenyl, hydroxy alkyl or hydrogen; each $R_3$ is a hydrogen, methyl, ethyl, or —$(C_nH_{2n}O)_xH$ wherein n is 2 or 3 and x is from about 1 to about 5; each X and each $X^1$ is, independently, a hydrocarbyl group containing from about 10 to about 18 carbon atoms; n is from 2 to 4; and $Y^-$ is any softener-compatible anion;

(B) from about 2% to about 25% of a dispersibility aid, comprising lauryl trimethyl ammonium chloride; and (C) from about 17% to about 75% of a nonaqueous solvent;

wherein X, $X^1$, or mixtures thereof are derived from $C_{11}$–$C_{31}$ fatty acyl groups having an Iodine Value of at least about 50.

7. A clear or translucent, rinse-added fabric softening composition comprising:

(A) from about 20% to about 80% of a softener compound of a formula selected from the group consisting of:

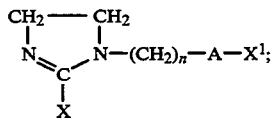

(I)

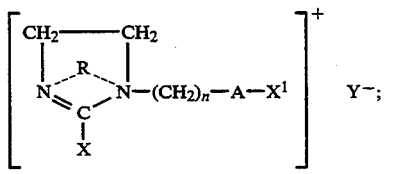

(II)

-continued (III)

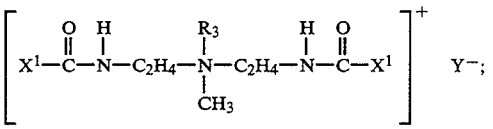

(IV)

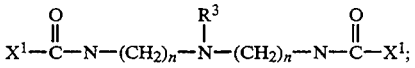

(V)

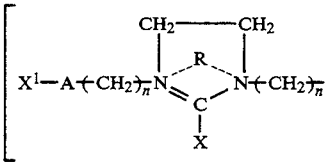

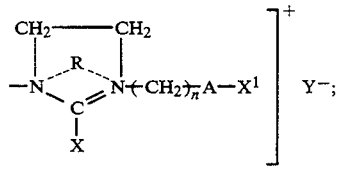

(VI)

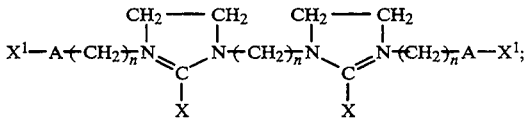

and (VII) mixtures thereof;

wherein each A is either —N($R^2$)C(O)—, —C(O)—N($R^2$)—, —O—C(O)—, —C(O)—O—, or a single covalent bond; each R is a $C_1$–$C_6$ alkyl group; each $R^2$is a $C_1$–$C_6$ alkyl, alkenyl, hydroxy alkyl or hydrogen; each $R_3$ is a hydrogen, methyl, ethyl, or —$(C_nH_{2n}O)_xH$ wherein n is 2 or 3 and x is from about 1 to about 5; each X and each $X^1$ is, independently, a hydrocarbyl group containing from about 10 to about 18 carbon atoms; n is from 2 to 4; and $Y^-$ is any softener-compatible anion;

(B) from about 2% to about 25% of a dispersibility aid, comprising monotallow trimethyl ammonium chloride; and (C) from about 7% to about 75% of a nonaqueous solvent;

wherein X, $X^1$, or mixtures thereof are derived from $C_{11-C31}$ fatty acyl groups having an Iodine Value of at least about 50.

8. A clear or translucent, rinse-added fabric softening composition comprising:

(A) from about 20% to about 80% of a softener compound of a formula selected from the group consisting of:

(I)

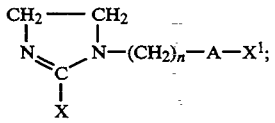

-continued (II)

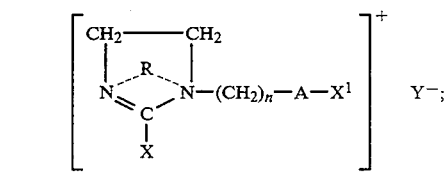

(III)

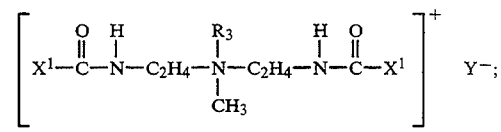

(IV)

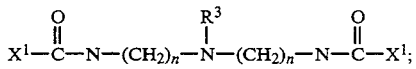

(V)

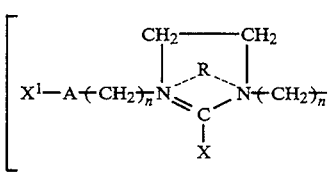

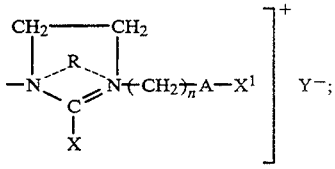

(VI)

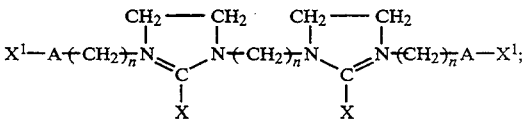

and (VII) mixtures thereof;

wherein each A is either —N($R^2$)C(O)—, —C(O)—N($R^2$)—, —O—C(O)—, —C(O)—O—, or a single covalent bond; each R is a $C_1$–$C_6$ alkyl group; each $R^2$is a $C_1$–$C_6$ alkyl, alkenyl, hydroxy alkyl or hydrogen; each $R_3$ is a hydrogen, methyl, ethyl, or —$(C_nH_{2n}O)_xH$ wherein n is 2 or 3 and x is from about 1 to about 5; each X and each $X^1$ is, independently, a hydrocarbyl group containing from about 10 to about 18 carbon atoms; n is from 2 to 4; and $Y^-$ is any softener-compatible anion;

(B) from about 2% to about 25% of a dispersibility aid, comprising $C_8$–$C_{22}$ alkyl choline ester; and (C) from about 17% to about 75% of a nonaqueous solvent;

wherein X, $X^1$, or mixtures thereof are derived from $C_{11}$–$C_{31}$ fatty acyl groups having an Iodine Value of at least about 50.

9. The composition of claim 8 wherein the dispersibility aid is $C_{10}$–$C_{14}$ alkyl choline ester.

10. A clear or translucent, rinse-added fabric softening composition comprising:

(A) from about 20% to about 80% of a softener compound of a formula selected from the group consisting of:

(I)

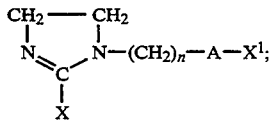

(II)

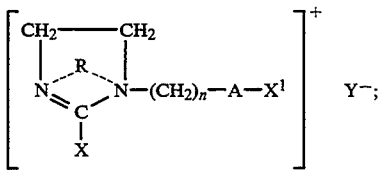

(III)

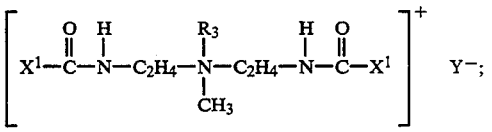

(IV)

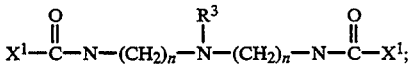

(V)

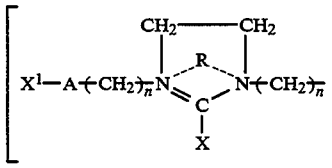

-continued

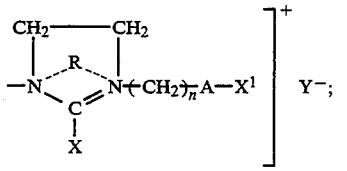

(VI)

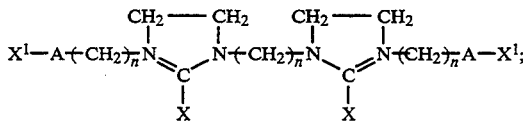

and (VII) minutes thereof;

wherein each A is either —N($R^2$)C(O)—, —C(O)—N($R^2$)—, —O—C(O)—, —C(O)— O—, or a single covalent bond; each R is a $C_1$-$C_6$ alkyl group; each $R^2$is a $C_1$-$C_6$ alkyl, alkenyl, hydroxy alkyl or hydrogen; each $R_3$ is a hydrogen, methyl, ethyl, or —$(C_nH_{2n}O)_xH$ wherein n is 2 or 3 and x is from about 1 to about 5; each X and each $X^1$ is, independently, a hydrocarbyl group containing from about 10 to about 18 carbon atoms; n is from 2 to 4; and $Y^-$ is any softener-compatible anion;

(B) from about 2% to about 25% of a dispersibility aid, comprising coco choline ester; and (C) from about 17% to about 75% of a nonaqueous solvent;

wherein X, $X^1$, or mixtures thereof are derived from $C_{11}$-$C_{31}$ fatty acyl groups having an Iodine Value of at least about 50.

* * * * *